US006844864B2

(12) United States Patent
Fluhrer

(10) Patent No.: US 6,844,864 B2
(45) Date of Patent: Jan. 18, 2005

(54) CIRCUIT ARRANGEMENT FOR ACTUATING A DISPLAY

(75) Inventor: Henry Fluhrer, Nuremberg (DE)

(73) Assignee: Diehl AKO Stiftung & Co., KG, Wangen (DE)

( * ) Notice: Subject to any disclaimer, the term of this patent is extended or adjusted under 35 U.S.C. 154(b) by 231 days.

(21) Appl. No.: 10/061,055

(22) Filed: Jan. 29, 2002

(65) Prior Publication Data

US 2002/0118155 A1 Aug. 29, 2002

(30) Foreign Application Priority Data

Feb. 24, 2001 (DE) ..... 101 09 157

(51) Int. Cl.[7] ..... G09G 5/00
(52) U.S. Cl. ..... 345/1.1; 345/3.1
(58) Field of Search ..... 345/1.1, 1.2, 2.1, 345/3.1, 87, 98, 100

(56) References Cited

U.S. PATENT DOCUMENTS

| | | | | | |
|---|---|---|---|---|---|
| 3,984,973 | A | | 10/1976 | Ho | |
| 4,382,256 | A | * | 5/1983 | Nagata | 340/7.29 |
| 4,542,799 | A | | 9/1985 | Komoto | |
| 4,684,935 | A | * | 8/1987 | Fujisaku et al. | 345/1.3 |
| 4,876,657 | A | * | 10/1989 | Saito et al. | 345/753 |
| 4,926,166 | A | | 5/1990 | Fujisawa et al. | |
| 5,021,775 | A | * | 6/1991 | Babin | 345/213 |
| 5,603,104 | A | * | 2/1997 | Phelps et al. | 455/90.3 |
| 5,694,141 | A | * | 12/1997 | Chee | 345/3.1 |
| 2003/0214458 | A1 | * | 11/2003 | Giemborek et al. | 345/1.1 |

FOREIGN PATENT DOCUMENTS

| | | | | |
|---|---|---|---|---|
| DE | 3117270 | | 11/1981 | |
| DE | 3689077 | T | 7/1988 | |
| DE | 3514821 | A1 | 5/1990 | |
| EP | 0089688 | B2 | 9/1983 | |
| EP | 0089688 | A2 | 9/1983 | |
| EP | 0195203 | A2 | 9/1986 | |
| EP | 0497605 | A1 | 8/1992 | |
| EP | 0 522 550 | A2 * | 1/1993 | G06F/3/14 |
| EP | 0195203 | B1 | 9/1993 | |
| EP | 0497605 | B1 | 4/1996 | |
| GB | 2075470 | A | 11/1981 | |
| GB | 2075726 | A | 11/1981 | |
| GB | 2 217 080 | A * | 10/1989 | G09G/3/20 |

OTHER PUBLICATIONS

Wolfgang Kabbeck (1983) "PSB7510–CMOS–Controller fur 7–Segment Flussigkristallanzeigen", Siemens Components 21, pp. 14–18.

"Data Sheet PD6320/PD6321, FIP/LCD Static Display Driver", Oct. 1996, NEC Corporation.

"MSM9006–01, –02, LCD Driver With Keyscan Function", Sep. 2000, OKI Semiconductor.

"Data Sheet PD16312, 1/4– ot 1/11–Duty FIP (VFD) Controller/Driver", Mar. 1997, NEC Corporation.

* cited by examiner

*Primary Examiner*—Amare Mengistu
(74) *Attorney, Agent, or Firm*—Scully, Scott, Murphy & Presser

(57) ABSTRACT

There is proposed a circuit arrangement for the actuation of a VFD, LED or LCD display, which has at least two control blocks for producing control signals for the various kinds of display, wherein the control signals of the control blocks are processed by a common driver component and the driver component transmits suitable actuation signals to the terminals of the VFD, LED or LCD display.

8 Claims, 5 Drawing Sheets

CIRCUIT ARRANGEMENT FOR ACTUATING A DISPLAY

BACKGROUND OF THE INVENTION

1. Field of the Invention

Figure 1:
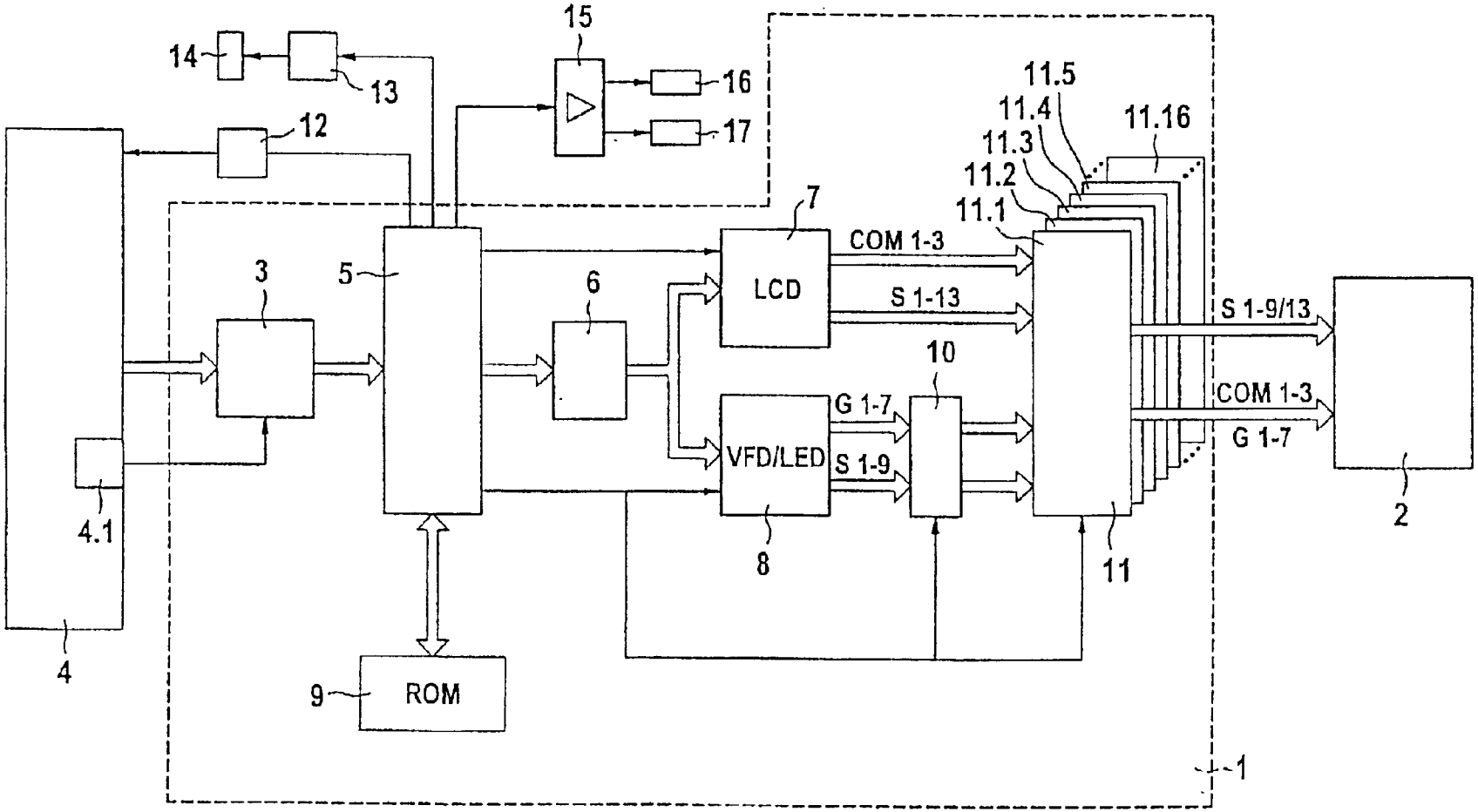

The invention concerns a circuit arrangement for actuating a VFD, LED or LCD display.

2. Discussion of the Prior Art

Such displays are widely used for example in small-scale electrical devices. They serve inter alia for displaying clock time or temperature. In the case of electronic cooker time switches, such displays additionally bear symbols for the set mode of operation of the cooker or oven or for other functions such as alarm or radio reception. A numerical display (for example for the clock time) is here usually implemented by means of a 7-segment display.

The actuation of such displays is effected in different ways in each case according to the nature of the respective display (VFD, LED, LCD). In the case of a vacuum fluorescence display (VFD), a heated cathode is disposed behind the digits to be displayed. The individual, mutually corresponding segments of the various (7-segment) digits are respectively connected in parallel with each other and form the anodes. Disposed between the heated cathodes and the segments serving as anodes are grids which each extend over the region of a digit. A segment of a given digits lights up when both the anode corresponding to that segment and also the grid corresponding to that digit are at positive voltage. Therefore each individual segment of each individual digit can be actuated separately by way of multiplex actuation of the segments and the digits.

In the case of a light emitting diode display (LED) the individual segments of the digits are respectively formed by individual light emitting diodes. The individual, mutually corresponding segments of the various digits are again connected in parallel to each other and form the cathode while the various digits form the anodes. In this case also each segment can be addressed separately by means of multiplex actuation.

The difference in actuation as between a VFD display and an LED display is on the one hand that, in the case of the VFD, either positive voltage or no voltage is applied to the terminals while positive voltage (for digits) or negative voltage (in the case of segments) or no voltage is applied to the terminals of the LED display. On the other hand, a VFD is operated at a relatively high voltage of 16 to 30 V, but with a low current of 0.1 to 2 mA, while an LED display requires only a low voltage of about 2 V but a higher current of 2 to 20 mA.

In contrast actuation of a liquid crystal display (LCD) is effected in a fundamentally different manner. This involves passive elements which are disposed on a substrate which provides for backscattering of the ambient light. When electrical voltage is applied to such an element, the crystals contained therein are oriented whereby the ambient light is absorbed at that location, whereby the element appears dark. In order to maintain that effect for a relatively long time however the element has to be recharged repeatedly (about every 100 ms). The voltage which in that situation is applied to the element must exceed a given minimum value in order to cause orientation of the crystals.

Now an LCD is constructed in such a way that up to 3 segments are connected in parallel with each other and thus form the one electrode. The other electrode is formed by three back electrodes (COM) which are each associated with a respective one of the three segments which are connected in parallel with each other. In this case also that again permits multiplex actuation. It will be noted however that in this case it is not just two voltage values (positive or negative and zero) which are applied to the individual terminals of the display, but also intermediate voltage values (in the described case, ⅓ and ⅔ of the voltage), so that specifically controlled recharging of individual elements is possible without influencing the other elements.

While actuation of a VFD and an LED display takes place in a similar manner and can be effected with an actuating circuit if the components are of suitably generous dimensions, a basically different actuating circuit is required for the actuation of a LCD. On the other hand however it would be desirable to have a single actuating circuit which is flexibly suitable for VFD, LED and LCD displays. That would result in an enhanced degree of component standardisation, a reduction in the complication and expenditure in terms of logistics and storage and a more flexible reaction to customer wishes.

SUMMARY OF THE INVENTION

Therefore the object of the present invention, based on the above-indicated state of the art, is to provide an actuating circuit which is capable of actuating both a VFD and LED display and also an LCD display.

That object is attained by a circuit arrangement for actuating a VFD, LED or LCD display, comprising a data receiver which receives from a central unit (4) the data necessary for actuation of the display, a control logic which checks the data received from the data receiver and extracts therefrom display data, at least one storage element in which the respectively current display data are stored, at least two control blocks which are in data communication with the at least one storage element or production of the control signals necessary for the display in dependence on the display data stored in the at least one storage element, wherein the first control block is such that it supplies the control signals necessary for an LCD display, and the second control block is such that it supplies the control signals necessary for a VFD display or an LED display or both for a VFD display and also for an LED display, and a common driver components to which the control signals of the control blocks and are fed and which produces from those control signals suitable actuation signals for the VFD, LED and/or LCD displays and transmits same to the corresponding display.

The capability of actuating a VFD, LED and LCD display is achieved by the provision of at least two control blocks, wherein one of the control blocks produces the control signals necessary for an LCD display and the other produces the control signals necessary for a VFD or LED display or for both displays. The control signals from the control blocks are fed to a common driver component which from those control signals produces suitable actuating signals for the VFD-/LED display and for the LCD display and transmits them to the appropriate display.

In a development of the invention there are provided three control blocks of which a respective one, supplies the necessary control signals for the LCD display, the VFD display and the LED display.

In addition, there can be provided one or more storage elements which are respectively associated with the individual control blocks.

In an embodiment of the invention the driver component has a plurality of driver elements, each of which is connected to a respective terminal of the VFD, LED or LCD display, and a suitable actuating signal is fed to that terminal.

It is further preferably provided that each driver element is connected to each of the control blocks so that it is supplied with all control signals necessary for actuation of the terminal of the connected display.

Preferably the control signals of the control blocks are connected in the driver elements in such a way that the terminal of the connected display is supplied with the respectively appropriate actuating signal. In a development of the invention that connection arrangement is effected in dependence on the nature of the connected display.

BRIEF DESCRIPTION OF THE ACCOMPANYING DRAWINGS

Preferably the control logic, the at least one storage element and the control blocks are digital while the driver component is analog.

Figure 2A:
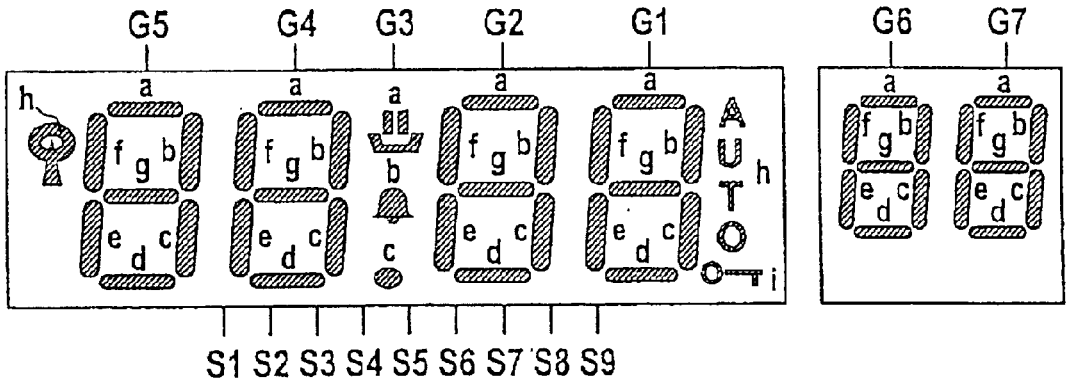
Figure 2B:
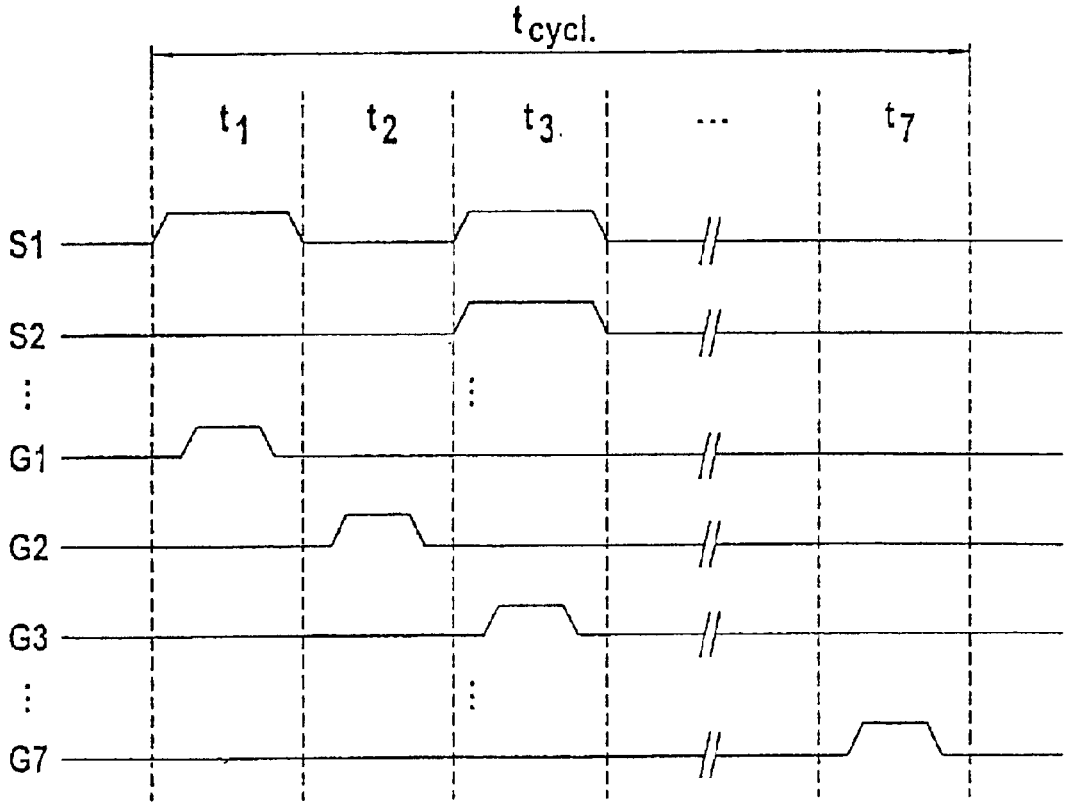
Figure 3A:
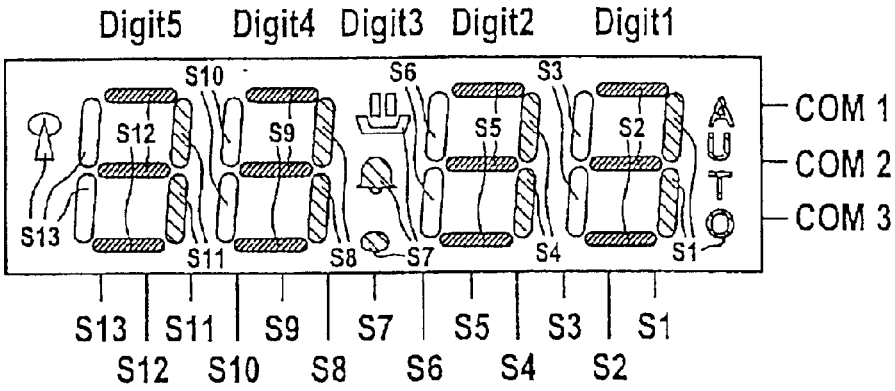
Figure 3B:
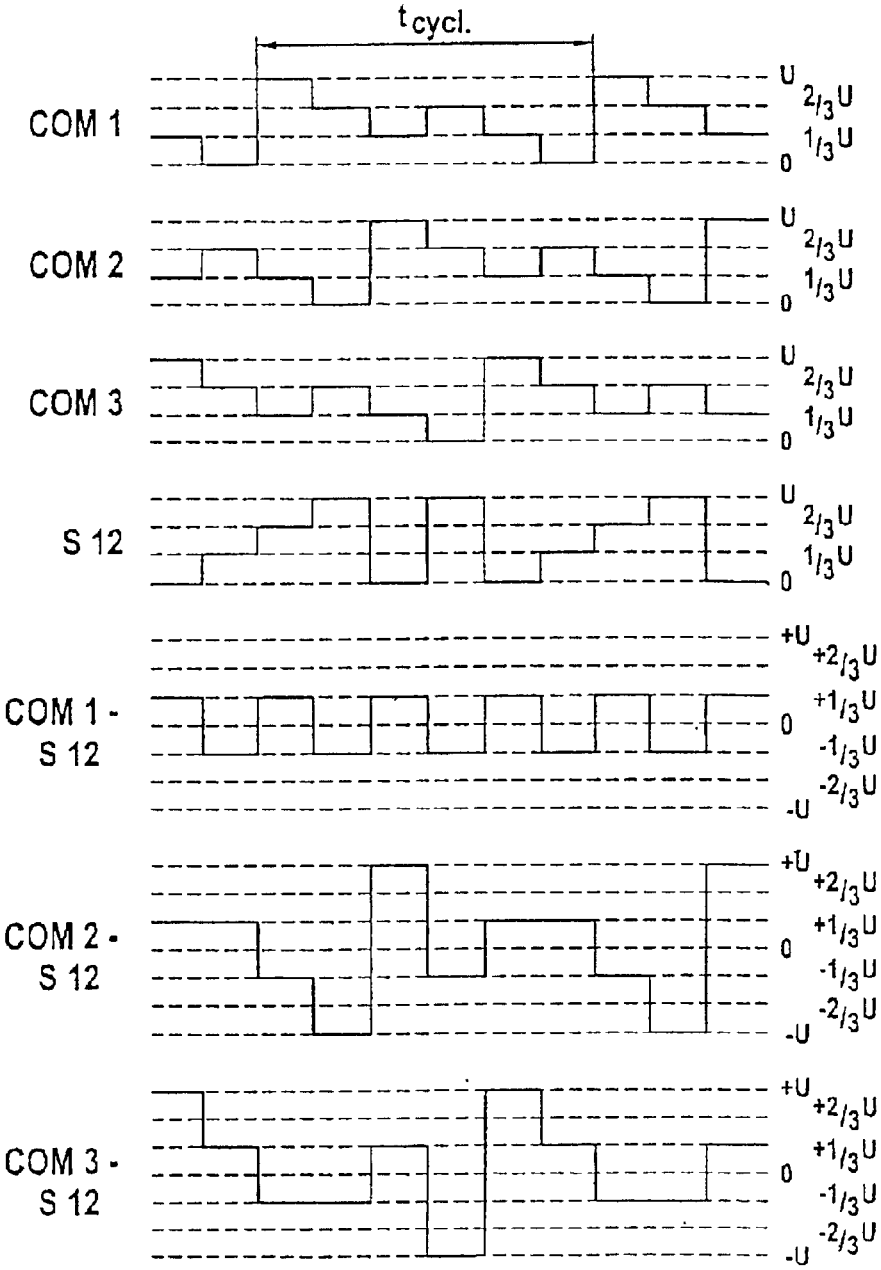
Figure 4:
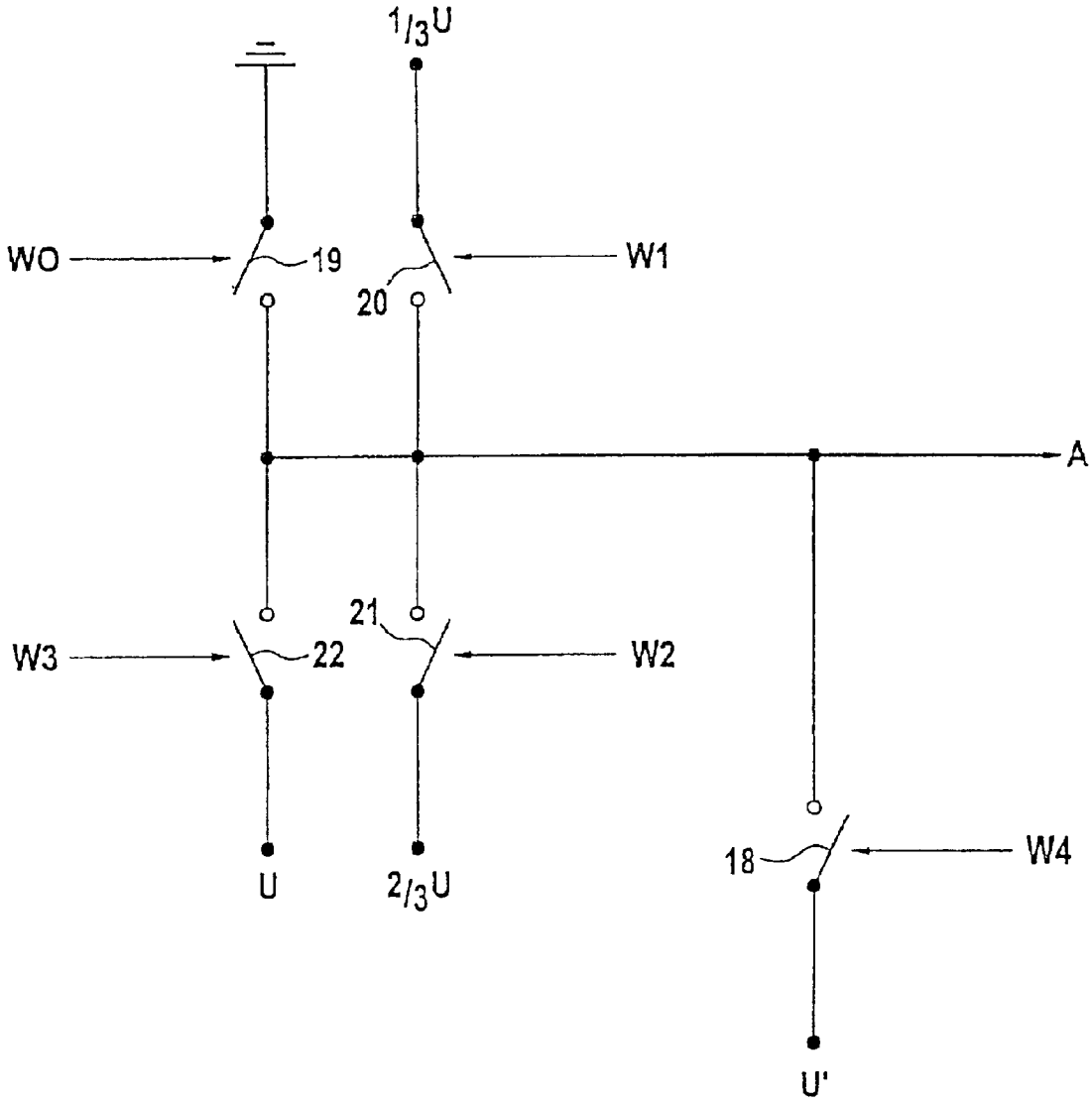
Figure 5:
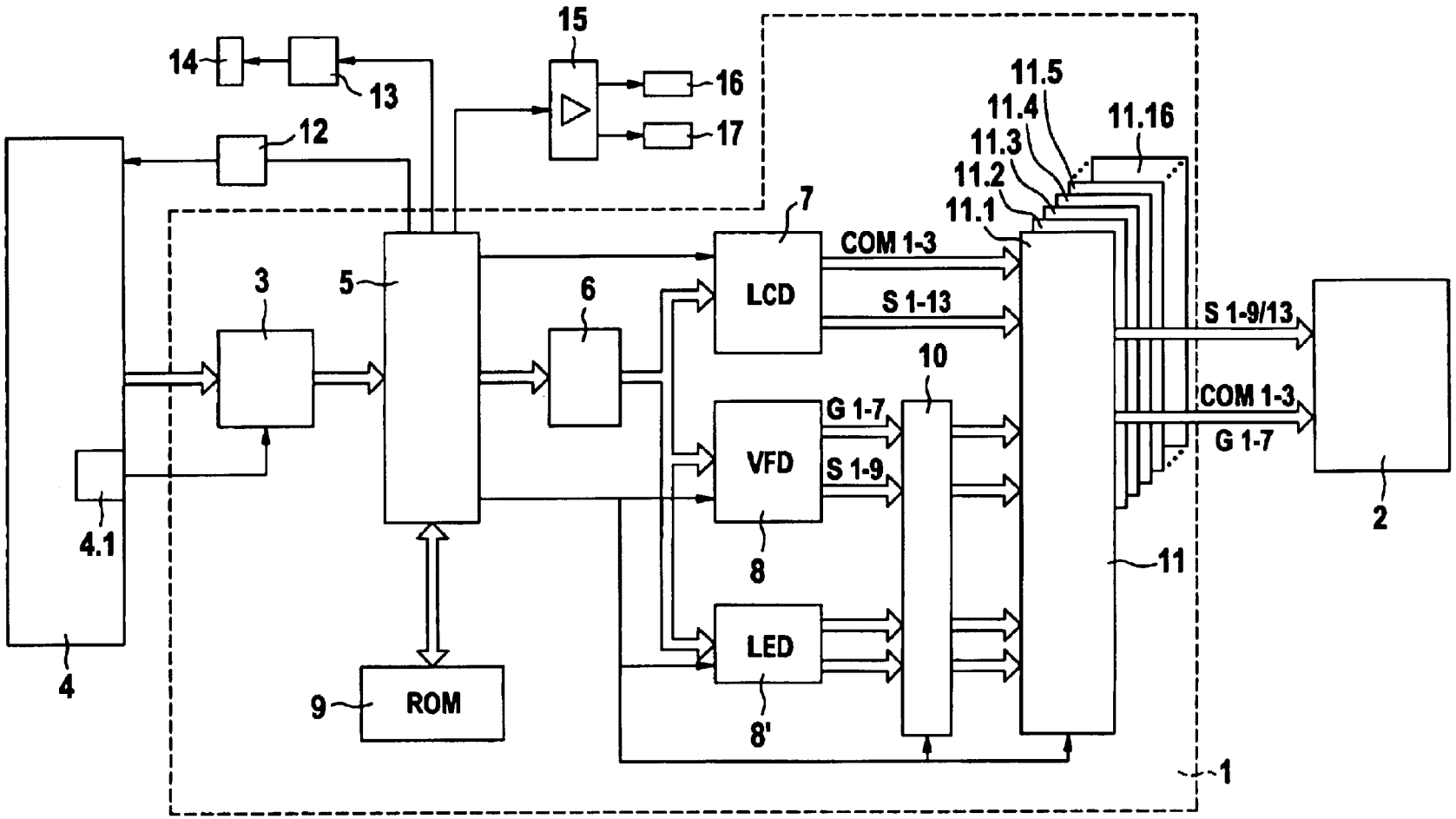

An embodiment of the invention will be described in greater detail hereinafter with reference to the drawing in which:

FIG. 1 shows a block circuit diagram of a circuit arrangement according to the invention, FIG. 2*a* shows the display of a VFD or LED display unit, FIG. 2*b* shows the configuration in respect of time of the actuating signals for a VFD or LED display, FIG. 3*a* shows the display of an LCD, FIG. 3*b* shows the configuration in respect of time of the actuating signals of an LCD, FIG. 4 is a diagrammatic view showing the principle of the circuit structure of a driver element, and FIG. 5 is a block circuit diagram showing a modification of the circuit arrangement shown in FIG 1

DETAILED DESCRIPTION OF A PREFERRED EMBODIMENT

A circuit arrangement 1 for actuating a VFD, LED or LCD display 2 has a data receiver 3 which receives data necessary for the actuation of the display from a microprocessor 4 which at the same time supplies the data receiver 3 with a clock time 4.1. The data receiver 3 transmits the received data to a control logic 5. The control logic 5 checks the received data and decodes them, by extracting from the received data addresses, control words and commands. The commands contain the actual display data. Those display data are forwarded to a data store 6 where they are stored. They remain stored without change until the display is to be altered. Then, fresh display data are stored in the data store 6.

In addition the control logic 5 notifies a first control block 7 which serves for the production of control signals necessary for an LCD display and a second control block 8 which serves for production of control signals necessary for a VFD or LED display, which actuation mode is set (for example VFD/LED 5 times, 6 times or 7 times multiplex, LCD 3 times multiplex, night reduction or load shedding; see below). The selected mode is stored in the ROM block 9 which is operatively connected to the control logic 5.

Depending on whether an LCD or a VFD/LED mode is set, the control block 7 or the control block 8 becomes active. On the basis of the display data provided for same by the data store 6 the active control block 7 or 8 respectively produces in the usual manner which is described in greater detail hereinafter the control signals COM 1 to 3 and S 1 to 13 (LCD) or G 1 to 7 and S 1 to 9 (VFD/LED) necessary for the respective display 2 (see also hereinafter).

The control signals from the control block 8 also pass through the level shifter 10 in which, when a VFD mode is present, the levels of the control signals are raised from the usual 3.3 V to 30 V necessary for a VFD. That rise in level is not necessary in the case of an LED mode. The level shifter 10 and likewise the control blocks 7 and 8 receive the information about the mode which is set, from the control logic 5.

The control signals of the control blocks 7 and 8 then go to the driver component 11. It has individual driver elements 11.1 to 11.16. They receive the respective control signals of the control block 7 or 8, process same and transmit them to the display 2 in a form which is suited to the display 2. In this case each of the driver elements 11.1 to 11.16 is connected to a respective terminal of the display 2.

Alternatively it is also possible for both control blocks 7 and 8 to be active at any time irrespective of the mode which is set. In that case however it is necessary for the driver elements 11.1 to 11.16 to receive control signals only from one of the control blocks 7 and 8, depending on the respective set mode (LCD or VFD/LED). The driver elements 11.1 to 11.16 receive the corresponding information directly from the control logic 5.

In addition the control logic 5 also controls the reset circuit 12 for the microprocessor 4, a buzzer circuit 13 for a buzzer 14 and a driver 15 for actuation of relays 16 and 17. It should also be noted that a voltage supply for the individual components of the circuit arrangement 1 is not shown, for the sake of clarity of the drawing; however, the voltage supply is implemented in the usual manner.

FIG. 2*a* shows the light segments of a VFD and an LED display respectively. The segments identified by a are connected in parallel with each other and are connected to the terminal S1, while the elements identified by b are connected to the terminal S2, and so forth. The terminals G1 to G7 are respectively connected to the grid extending over a digit (possibly with symbols disposed therebeside).

The actuation of such a display will now be described with reference to FIG. 2*b*, in which the configuration in respect of time of the signals at the terminals S1 to S9 and G1 to G7 is shown in extracts. During the period to a signal, that is to say voltage, is applied both at the terminal S1 and also at the terminal G1. Accordingly this causes lighting of the segment a of that digit which belongs to the grid connected to the terminal G1. In the period t2 the grid associated with the terminal G2 is actuated, but here no segments are actuated so that the digit associated with G2 remains dark. The symbols a and b associated with the grid connected to the terminal G3 however light up again as a signal is applied to each of the terminals S1 and S2 during the period t3.

In the present case seven grids are actuated so that the cycle duration is made up of the intervals of time t1 to t7. This therefore involves a 7 times multiplex. In a situation involving omission of the grids belonging to G6 and G7 the cycle duration would be correspondingly reduced, and that would then involve a 5 times multiplex.

Basically actuation for an LED display takes place just as described above, except that a negative voltage is applied at the terminals S1 to S9, instead of a positive voltage.

FIG. 3*a* shows the display elements of an LCD. In each case up to three of the display elements are connected together in parallel and connected to the terminals S1 to S13. The back electrodes of the three elements are respectively connected to the terminal COM 1, COM 2 or COM 3.

FIG. 3*b* shows the configuration in respect of time of the signals at the terminals COM 1, COM 2 and COM 3 and at the terminal S2, this involving a standard procedure for the actuation of an LCD. The signals at the terminals S1 to S13 are of opposite polarity in relation to the signals at the terminals COM 1, COM 2 and COM 3 so that for example a voltage corresponding to COM 1 minus S12 is applied at the upper display element S12, a voltage corresponding to COM 2 minus S12 is applied at the middle display element S12 and a voltage corresponding to COM 3 minus S12 is applied at the lower display element S12. The voltage differences which occur at the upper display element (corresponding to COM 1 minus S12) are too slight for the crystals to be able to be oriented. Therefore no display takes place there. In the case of the middle and lower display elements however large voltage differences of 2 U occur, and for that reason here orientation of the crystals and thus display occurs.

FIG. 4 now shows a circuit diagram illustrating the principle of the circuitry respectively contained in the driver elements 11.1 to 11.16 for producing the actuating signals for the display 2. In the VFD and LED mode the switches 18 and 19 are actuated by the control block 8 by means of digital signals W4 and W0. If a signal, that is to say voltage, should occur at the output A, that is to say at the corresponding terminal of the display 2, then the switch 18 is closed by way of a digital signal W4 while the switch 19 and also the switches 20, 21 and 22 remain opened. When using a VFD display the voltage U' which now occurs at the output A is 30 V, while when using an LED display, it is only about 2 V. If no signal, that is to say no voltage, should occur at the output, the switch 18 is opened and the switch 19 closed by a digital signal W0. Thus, a signal suitable for a VFD or LED element can be produced by way of the (suitably dimensioned) switches 18 and 19. The respective driver element 11.1 to 11.16 can receive the information as to whether a voltage U' of 30 V or only 2 V is used (corresponding to the control of a VFD display or an LED display), either from the level shifter 10 or from the control logic 5 directly (see FIG. 1).

The switches 19, 20, 21 and 22 are used to control an LCD element. The voltage at the output A can be regulated to 0, ⅓ U, ⅔ U or U, by closure of the corresponding switch by means of the associated digital signal W0, W1, W2 or W3 coming from the control block 7, wherein U is typically 3.3 V.

The circuit arrangement illustrated in FIG. 5 of the drawings is a modification of that shown and described in FIG. 1, in which a simplification thereof has the control block 8 adapted to actuate only a VFD element upon actuation of the appropriate switches, as mentioned hereinbelow. The actuation of the LED element is effected through the provision of a third or separate control block $8^1$, whereas for the remainder, the circuit arrangements of FIGS. 1 and 5 are essentially identical or similar and are identified by the same reference numerals.

In that way, both an LCD element and also a VFD and LED element can be actuated by actuation of the appropriate switches by the digital signals W0, W1, W2, W3 and W4 coming from the control blocks 7, $8^1$, by way of one and the same output or tenninal A.

The control logic 5, the storage element 6 and the control blocks 7, 8 and $8^1$ of the circuit arrangement 1 are digital while the driver component 11 with the driver elements 11.1 to 11.16 is analog. The entire circuit arrangement 1 is in the form of an integrated circuit (IC). The reset circuit 12, the buzzer circuit 13 and the relay driver 15 are also integrated into that IC.

What is claimed is:

1. A circuit arrangement (1) for actuating a VDF, LED or LCD display (2), comprising: at least one storage element (6) in which there are stored display data;

at least two control blocks (7,8) which are in data receiving connection with said storage element (6) for generating control signals necessary for the display in dependence upon the display data stored in said storage element (6);

a first control block (7) of said at least two control blocks (7, 8) supplying control signals for an LCD display;

a second control block (8) of said at least two control blocks (7, 8) supplying control signals selectively for a VFD or LED display, or both a VFD and LED display; and a common driver component (11) which is electrically connected with said at least two control blocks (7, 8) and with said respective VFD, LED or LCD displays, said different types of displays being connected to the same connections of said common driver component (11), said common driver component (11) generating actuating signals for the respective VED, LED or LCD displays from the control signals received by said common driver component (11) from said at least two control blocks (7, 8) and conveys said actuating signals to an applicable of said displays.

2. A circuit arrangement according to claim 1 wherein there are provided three said control blocks, wherein the first control block (7) supplies the control signals necessary for the LCD display, the second control block (8) supplies the control signals necessary for the VFD display, and a third control block $8^1$ supplies the control signals necessary for the LED display.

3. A circuit arrangement according to claim 1 or claim 2, wherein there are provided a plurality of storage elements which are respectively associated with the LCD and the VFD/LED control block (7, 8), and each LCD, VFD and control block (7,8, $8^1$) respectively.

4. A circuit arrangement according to claim 2, wherein said common driver component (11) has a plurality of driver elements (11.1–11.6) each said driver element (11.1–11.16) is connected to each of the control blocks (7, 8 $8^1$) so as to receive the control signals which are necessary for the actuation of the one terminal of the VFD, LED or LCD display (2).

5. A circuit arrangement according to claim 2, wherein said common driver component (11) has a plurality of driver elements (11.1–11.6) each said driver element (11.1–11.16) is connected to each of the control blocks (7, 8, $8^1$) so as to receive the control signals which are necessary for the actuation of the one terminal of the VFD, LED or LCD display (2).

6. A circuit arrangement according to claim 5, wherein the connection of the control signals in the driver elements (11.1–11.16) is effected in dependence on the nature of the connected display (2).

7. A circuit arrangement according to claim 1 wherein said common driver component (11) has a plurality of driver elements (11.1–11.16), each said driver element (11.1–11.16) being connected to a respective terminal of the VED, LED or LCD display (2) and feeding the corresponding actuation signal to said terminal.

8. A circuit arrangement according to claim 1, wherein the control logic (5), the at least one storage element (6) and the control blocks (7, 8, $8^1$) are digital in operation while the common driver component (11) is analog in operation.

* * * * *